United States Patent [19]

Slegten

[11] 4,171,102

[45] Oct. 16, 1979

[54] PARTITIONS FOR A TUBE GRINDING MILL

[76] Inventor: Pierre A. Slegten, 158, Ave. du Prince d'Orange, Brussels, Belgium

[21] Appl. No.: 880,988

[22] Filed: Feb. 24, 1978

[30] Foreign Application Priority Data

Feb. 25, 1977 [BE] Belgium ..... 851835

[51] Int. Cl.[2] ..... B02C 17/18

[52] U.S. Cl. ..... 241/70; 241/171

[58] Field of Search ..... 241/70–72, 241/153, 171, 181

[56] References Cited

U.S. PATENT DOCUMENTS

| | | | |
|---|---|---|---|
| 1,591,941 | 7/1926 | Newhouse | 241/72 X |
| 3,801,025 | 4/1974 | Slegten | 241/70 |
| 3,990,644 | 11/1976 | Hanke et al. | 241/181 X |
| 4,089,477 | 5/1978 | Tiggesbaumker et al. | 241/181 X |

*Primary Examiner*—Howard N. Goldberg

[57] ABSTRACT

A partition for a tube grinding mill having inlet openings in an upstream wall thereof and a central discharge opening in a downstream wall thereof, a polygonal envelope formed in said partition defining a central discharge area communicating with said discharge opening and a coaxial reservoir chamber, passages through said envelope connecting said chamber with said discharge area, and scoops defining said passages partially extending in said chamber and partially in said discharge area having a deflector member in said discharge area to divert material towards said discharge opening during rotation of the mill, said scoops being adjustably mounted in different angular positions.

5 Claims, 8 Drawing Figures

PARTITIONS FOR A TUBE GRINDING MILL

In U.S. Pat. No. 3,801,025 dated Apr. 2, 1974 it has been described a tube grinding mill having a partition extending transversely therein downstream of one grinding compartment, said partition including an upstream wall with passage apertures of a size to permit passage of the ground material of a predetermined size therethrough but not the grinding members and having spaced axially from said upstream wall a downstream wall with a central discharge passage, the space between said upstream and downstream walls defining a ground material reservoir, said reservoir comprising scoops, the rotation of said tube mill causing said scoops to pick up material from the reservoir, lift said material above mill axis and dump it from there on a central deflector which diverts material through the discharge passage of the downstream wall, said scoops comprising a member in semi-cylindrical form, said semi-cylindrical member being supported by a rotatable shaft with means for rotating said shaft, the material holding volume of said semi-cylindrical member being adjustable in rotating its supporting shaft.

The method and partition according to U.S. Pat. No. 3,801,025 has proved to be particularly efficient in the form illustrated in FIGS. 1 and 2 of the said patent. Nevertheless, this partition, economical for mills of large size, is very costly for mills of medium and small diameter.

The subject of the present invention is a partition providing the method of control according to the said patent in a simplified form.

Essentially, the invention consists in the omission of the central cone existing in the partitions according to the U.S. Pat. No. 3,801,025 and in its replacement by deflectors integral with the scoops.

As in this patent, the partition is constituted by an upstream wall provided with calibrated openings and a downstream wall forming a disc of a solid substance; it is provided with a central discharge opening; the upstream and downstream walls form a reservoir chamber for material in which the latter is entrained, by the rotation of the mill, above the axis of the latter and is discharged towards a deflector member which directs it towards the discharge opening and which is surrounded by a polygonal envelope perforated with holes; as in U.S. Pat. No. 3,801,025, the partition comprises control means for modifying the level of the material in the reservoir chamber and consisting of scoops the useful volume of which is adjustable.

A partition forming the subject of the invention is characterised in that the deflector member is constituted by the scoops themselves which pass through the openings formed in the polygonal envelope and extend into the interior of said envelope and more specifically by the ends of the scoops penetrating into the polygonal envelope.

The omission of the central cone clears the discharge ends of the scoops which become completely accessible from the interior of the mill. For this reason, the device for causing the scoops to pivot according to U.S. Pat. No. 3,801,025, may be replaced by a system which provides each scoop with a flange integral with the scoop and supported by the inner surface of the polygonal envelope which closes the reservoir chamber towards the center of the mill. The flange is of the multi-hole type and may be fixed by nuts on pins integral with the polygonal envelope. Control of the scoop is provided by selecting the holes through which the pins pass.

The omission of the cone and its replacement by the multi-hole flange device permits a simple manual control from the interior of the mill and substantially reduces the cost of the partition. The partition in accordance with the invention enables the advantages of the method and control according to U.S. Pat. No. 3,801,025, to be extended to mills of medium and small diameter.

For a better understanding of the invention a non-limiting embodiment is described hereafter with reference to the drawings, in which.

Figure 1:
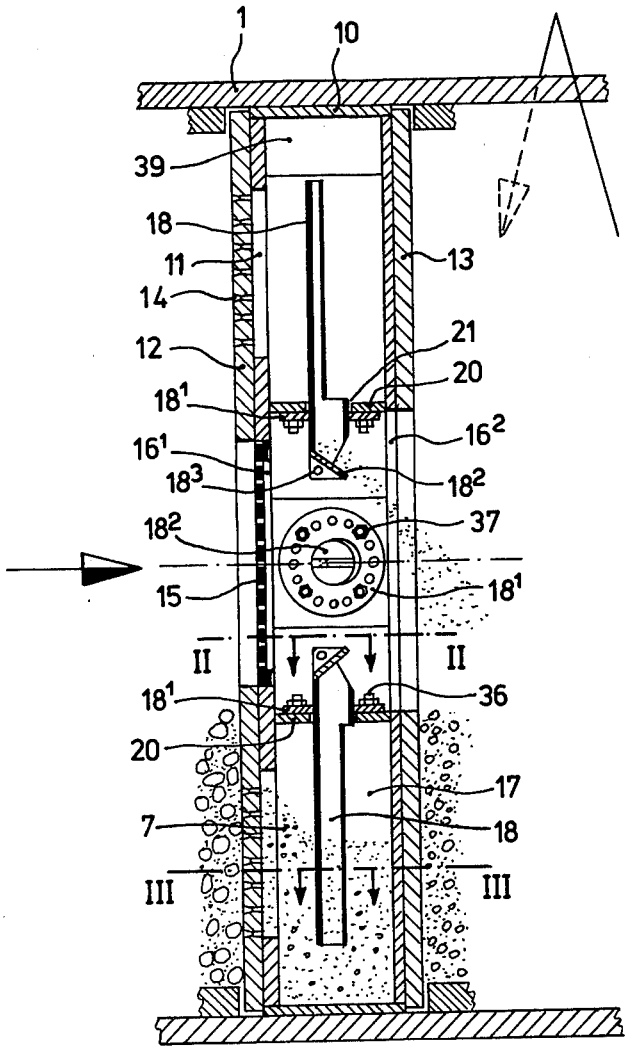
FIG. 1 is a vertical section through the partition forming the subject of the invention, with the partition in an intermediate position in a mill comprising two compartments.
Figure 1A:
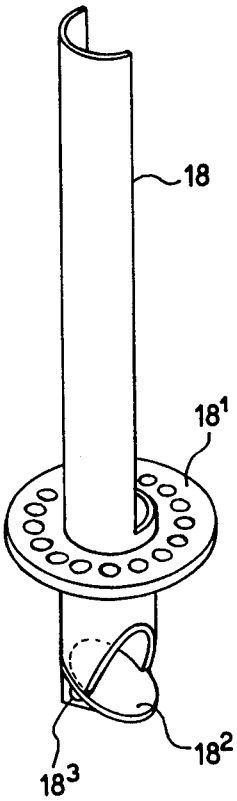
FIG. 1A is a detail in perspective of one scoop.

As shown in FIGS. 1 and 1A, the partition comprises a frame 10 mounted in the mill drum or shell 1 of the mill and preferably assembled by welding. The material advances in the sense of the horizontal arrow. The upstream surface of the frame (considered in the sense of advance of the material) comprises large openings 11 surrounding a central opening 16$^1$. The downstream surface of the frame is solid except for a central opening 16$^2$. The upstream wall of the frame is protected by a screen 12 provided with openings 14 which face the openings 11 and permit the passage of the sufficiently ground material whilst retaining the grinding media and the insufficiently ground particles. If the partition is situated between two grinding compartments (as in the case in FIG. 1) its downstream wall comprises a lining 13; if the partition is situated against the outlet end of the mill, there is no lining 13. The screen 12 and the lining 13 are of a wear resistant material; they are formed of removable sectors, bolted to the frame 10, so as to permit easy replacement thereof. In the opening 16$^1$ of the upstream wall, there is a screen 15 provided with holes sufficiently narrow to retain the grinding media; this grid permits the passage of ventilation air through the mill. When grinding takes place by the wet process, there is no ventilation and the centre of the upstream wall of the partition may be solid. The upstream and downstream walls of the frame define a small annular chamber 17 closed towards the centre of the mill by a polygonal envelope 20 (octagonal in the case of FIG. 1) perforated by circular openings 21. Each opening 21 is surrounded by four threaded pins 36 disposed at 90° to one another, integral with the polygonal envelope 20 and situated on the inside of the latter.

In accordance with the invention, the chamber 17 is provided with a lifting scoop 18 at right angles to each opening 21. This scoop 18 passes through the opening 21; it is straight and has, in the chamber 17, a semi-circular cross-section. At the end of the semi-circular section the scoop comprises an annular flange 18$^1$ which is placed against and inside the polygonal envelope 20. Flange 18$^1$ is perforated and has sixteen equally spaced holes, each fourth hole corresponding to one of the four pins 36. Thus, the flange may be mounted in different angular positions on the pins. Screws 37 and washers 38 (see FIG. 2) hold the flange 18[1] on the pins. The scoop 18, fixed to the frame solely by the flange 18[1] may thus be orientated in various different positions. Inside the polygonal envelope 20, the scoop is cylindrical and terminates in a discharge opening which is formed by cutting off the end of the scoop in the form of a double bevel and welding a deflector 18[2] to the edge of one of the bevels. This deflector 18[2] is welded to a part provided with a hook-receiving eye 18[3].

The mill rotates in the sense of the broken arrow. The annular chamber 17 constitutes a reservoir. The material 7 from the grinding compartment situated upstream of the partition, penetrates into the said reservoir when it is sufficiently fine to pass through the openings 14. During rotation of the mill, the scoops pass into the material 7 contained in the reservoir and entrain a portion of the latter in the concave shape provided by their semi-circular cross-section. During the passage of the scoops above the axis of the mill, the material which they contain slides towards their discharge orifice passing through the opening 21; the deflector 18[2] diverts the material towards the central opening 16[2]. A portion of the material leaving the deflectors 18[2] may fall into the polygonal envelope 20, but, since the frame 10 forms a barrier upstream of the envelope, the material flows towards the central opening 16[2] due to the combined effects of the rotation of the mill and of the material slope which is formed in the polygonal envelope 20.

Figure 2A:
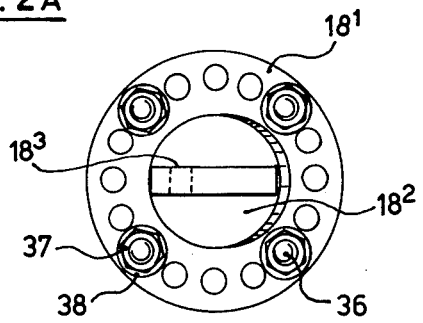
FIG. 2A is an enlarged view according to II—II in FIG. 1.
Figure 3A:
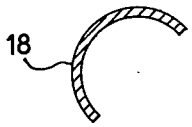
FIG. 3A is a section according to III—III in FIG. 1.
Figure 2B:
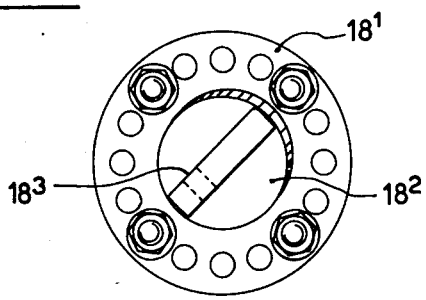
FIGS. 2B and 2C show the same view in two other positions of the scoop.
Figure 3B:
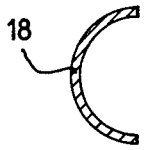
FIGS. 3B and 3C show the same section respectively in the positions of FIGS. 2B and 2C.
Figure 2C:
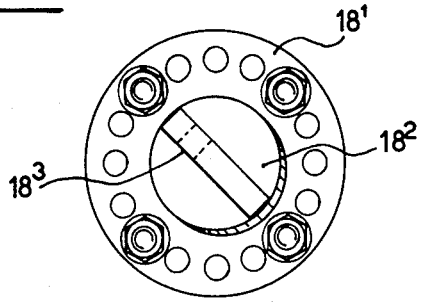
Figure 3C:
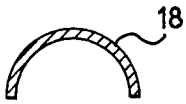

FIG. 2A shows the position of the deflector 18[2] when the scoop is in the position shown in FIG. 1; FIG. 3A shows the corresponding position of the scoop in the chamber 17.

FIGS. 2B, 2C, 3B and 3C, show respectively the deflector and the scoop in a completely closing and completely opening position, that is to say in the positions in which a unit length of scoop has a minimum lifting capacity and a maximum lifting capacity of the material.

By orientating the scoops, their useful capacity can be regulated and the level of the material in the partition is controlled and consequently in the compartment located upstream of the partition in accordance with the method of control according to U.S. Pat. No. 3,801,025.

In order to be more manageable the scoops 18 may only extend over a portion of the length of the chamber 17; in that case, blades 39 situated in advance of the scoops with respect to the sense of rotation of the mill and integral with the frame 10, extend the scoops and bring the material towards the scoops during the rotation of the mill. Since the cone 29 of U.S. Pat. No. 3,801,025 is replaced by the deflectors 18[2] which are part of the scoops 18, the result is a reduction in the weight of steel used as well as the omission of a heavy part which takes up space and is costly.

The omission of the cone makes the centre of the partition very accessible: access to the flanges 18[1] permitting control of the scoops from the interior of the mill is greatly facilitated.

In order to adjust a scoop, a pulley block is mounted between the hooking eye 18[3] of a scoop of which the screws 37 are tightened and the eye 18[3] of the scoop to be rotated, after having removed the screws 37 and the washers 38 therefrom. By means of the pulley block, the scoop to be adjusted is disengaged from the dust particles accumulated in the interstices which it contains and the flange 18[1] is disengaged from the pins 36. The scoop is rotated manually and the flange 18[1] is refixed in other holes on the pins 36.

It will be noted that the flange 18[1] and the pins 36 replace the conical seats 19, the shaft 22, a packing 23, a bearing 24 and all the delicate mechanism of the scoops of the specification of U.S Pat. No. 3,801,025. The new adjusting device is simple, robust and is economical for mills of medium and small diameter.

Another advance of the invention is to facilitate the passage of ventilation air. In the partitions according to the U.S. Pat. No. 3,801,025, the said air passes partially through the holes 14 in the screens 12 and partially through the screen 15; however, the cone restricts the passage of air at the screen 15 and the envelope 20 reduces the surface of the passage at the section of openings 21 for the air leaving the holes 14; for this reason, the total surface of the passage available for the air is relatively limited and a considerable depression through the passage of air in the partition may result. The omission of the cone has the advantage of freeing the passage for the air from the screen 15 and of bringing the depression to a normal value.

What I claim is:

1. In a tube grinding mill forming a drum containing grinding media, said drum rotating on its longitudinal axis to tumble said media, a partition extending along the cross-section of said drum and comprising an upstream wall provided with inlet openings, a downstream wall, an outer peripheral wall connecting said upstream wall with said downstream wall, said downstream wall being provided with a central discharge opening, an inner peripheral wall surrounding said central discharge opening and connecting said downstream wall with said upstream wall thus forming a polygonal envelope defining a central discharge area in the partition and also defining with said downstream wall, said upstream wall and said outer peripheral wall an annular reservoir chamber coaxial with said central discharge area, said inlet openings of the upstream wall permitting entry of material ground to a determined extent into said reservoir chamber while retaining the grinding media and insufficiently ground material outside of said chamber, passages through said envelope connecting said reservoir chamber with said central discharge area, scoops defining said passages, a portion of each scoop extending within said reservoir chamber and forming a semicylindrical member, another portion of each scoop extending in the central discharge area and forming a deflector member, the rotation of the tube mill causing part of the material within the reservoir chamber to be entrained by the scoops above the mill axis and from there to slide down each scoop towards its deflector member which diverts material towards the discharge opening, each scoop as well as the peripheral area surrounding each corresponding passage in the polygonal envelope comprising cooperating means for rotating the scoop about its longitudinal axis for varying the holding volume of the portion of the scoop extending within the reservoir chamber.

2. A partition according to claim 1 in which the end of the scoops penetrating into the polygonal envelope is cylindrical and cut off in the form of a double bevel, a deflector plate being fixed to the edge of one of the bevels so as to deflect the material towards the central discharge opening.

3. A partition according to claim 1, in which the cooperating means for rotating each scoop about its longitudinal axis comprises an annular flange of the multi-hole type integral with the scoop and threaded pins provided with nuts fixed to the peripheral area surrounding the corresponding passage in the polygonal envelope.

4. A partition according to claim 3, in which the annular flange is perforated with sixteen equally spaced holes, each four holes corresponding to one of the threaded pins, said pins being integral with the polygonal envelope, provided with nuts and situated within the envelope, at 90° to one another at the peripheral area surrounding each passage such that the said flange and consequently the scoop may be mounted on the envelope in different angular positions.

5. A partition according to claim 1, wherein the scoops only extend over a portion of the annular chamber, said annular chamber further comprising on the periphery thereof blades integral with the outer peripheral wall of the partition, said blades feeding the material towards the scoops.

* * * * *